US010278419B2

(12) United States Patent
Bavar

(10) Patent No.: US 10,278,419 B2
(45) **Date of Patent: *May 7, 2019**

(54) HOOKAH HEAT MANAGEMENT ACCESSORY

(71) Applicant: KALOUD, INC., Los Angeles, CA (US)

(72) Inventor: Reza Bavar, Los Angeles, CA (US)

(73) Assignee: KALOUD, INC., Los Angeles, CA (US)

( * ) Notice: Subject to any disclaimer, the term of this patent is extended or adjusted under 35 U.S.C. 154(b) by 668 days.

This patent is subject to a terminal disclaimer.

(21) Appl. No.: 14/994,907

(22) Filed: Jan. 13, 2016

(65) Prior Publication Data

US 2016/0198762 A1 Jul. 14, 2016

Related U.S. Application Data

(63) Continuation of application No. 13/489,475, filed on Jun. 6, 2012, now Pat. No. 9,237,770.

(51) Int. Cl.
*A24F 1/30* (2006.01)
*A24F 47/00* (2006.01)

(52) U.S. Cl.
CPC ..... *A24F 1/30* (2013.01); *A24F 47/00* (2013.01)

(58) Field of Classification Search
None
See application file for complete search history.

(56) References Cited

U.S. PATENT DOCUMENTS

| | | | |
|---|---|---|---|
| 8,490,630 | B2 | 7/2013 | Boutros et al. |
| 2007/0056599 | A1 | 3/2007 | Zoumut |
| 2009/0095310 | A1 | 4/2009 | Chaoui |
| 2010/0212679 | A1 | 8/2010 | Bishara |
| 2012/0118306 | A1 | 5/2012 | Mehio |

OTHER PUBLICATIONS

WO, PCT/US2013/044380 ISR, dated Sep. 18, 2013.
WO, PCT/US2013/044380 IPRP, dated Dec. 9, 2014.
EP, 13800268.0 Supplementary Search Report, dated Mar. 16, 2016.

*Primary Examiner* — Michael J Felton
(74) *Attorney, Agent, or Firm* — Myers Wolin, LLC

(57) ABSTRACT

A Hookah Heat Management Accessory comprising a base plate configured to rest on the tobacco bowl sitting on the top of a Hookah and which conducts heat from charcoal, or other heat source, to the tobacco beneath it; an insulating wall connected to the base plate; an inner lid that mates to the aforementioned wall piece; and an outer lid that is loosely attached to the inner lid allowing for rotation, ventilation, and thermal regulation.

13 Claims, 6 Drawing Sheets

HOOKAH HEAT MANAGEMENT ACCESSORY

CROSS REFERENCE TO RELATED APPLICATIONS

The present application is a continuation of U.S. application Ser. No. 13/489,475, filed Jun. 6, 2012 and titled "HOOKAH HEAT MANAGEMENT ACCESSORY," which is hereby incorporated by reference in its entirety.

TECHNICAL FIELD OF THE INVENTION

The present invention relates to the field of smoking implements and more specifically to heat management devices for charcoal, or other heat source, used in conjunction with a smoking apparatus, which may be known as Hookah, Nargile, Argile, Gelyoun, Hubbly-Bubbly, Water Pipe, Qalyan, Shisha, etc.

BACKGROUND

It has been nearly 450 years since Abul-Fath Gilani, a Persian physician at the North Indian court of the Mughal Emperor Jalal-ud-Din Muhammad Akbar, or Akbar the Great, first passed the smoke of tobacco through a small bowl of water to purify and cool the smoke. In this way, Abul-Fath Gilani invented the Hookah [depending on the region also known as Nargile, Argile, Gelyoun, Hubbly-Bubbly, Water Pipe, Qalyan, Shisha, etc.) and gave birth to a social and cultural phenomenon enjoyed by hundreds-of-millions worldwide.

In the last three decades, since the advent of flavored Shisha (Hookah Tobacco), Hookah use has gained popularity outside of its native regions, in South Asia and the Middle East, and is now used by people throughout North America, South America, Europe, Australia, Asia, and Africa.

Hookahs are renowned for facilitating deep social interactions brought about through the process of deliberate breathing. Each puff of a Hookah forces a person to take a deliberate breath, and anyone familiar with meditation, Yoga, Martial Arts, or SCUBA and Free-Diving knows that the act of breathing deliberately, focusing on each inhale and exhale, slows a person down and, as individuals slow down, their attention is brought out of the chaos of daily life and into the tranquility of the present. Once people are present, conversations become more meaningful. They pay attention to what other people are saying and that attention is reciprocated. This process feeds on itself and the stories become deeper, the connection more meaningful, and people find themselves bonding over Abul-Fath Gilani's now famous invention. In this way, one can explore the validity of Mark Twain's statement regarding people that "(t)here was never yet an uninteresting life. Such a thing is an impossibility. Inside of the dullest exterior there is a drama, a comedy, and a tragedy."

The typical Hookah is composed of six (6) parts: the head, where tobacco and/or other combustible materials are placed; the tray, where ash from charcoal, or debris from another heat source, is deposited; the stem, where the smoke from the head is drawn down into the base; the base, where the smoke from the stem is passed through water and other liquids; the hose, where the smoke from the base is drawn into the user's mouth; and the valve, where stale smoke from the base is purged out by blowing through the hose. The typical Hookah experience involves multiple people using the same Hookah by passing the hose from person-to-person.

Hookahs are used by smoking the combustible material in the head. The material in the head is typically combusted using a heat source; usually ignited charcoal. Heating the combustible material produces smoke, which is drawn into the water in the base through the stem. The stem is arranged to penetrate the surface of the water in the base to allow for filtration of the smoke obtained from the head. The user inhales the air from the base and induces a partial vacuum in the base that draws in smoke from the head through the stem into the base and finally through the hose to the user.

This arrangement requires that heat source, such as charcoal, or other heat source, be provided and suitably ignited. This heat source must be maintained during smoking so that the combustible material is suitably cooked without being overly burned. During this process, it is possible for by-products of combustion, such as volatile gasses, ultra-fine particles, and ash to be conducted into the water receptacle along with smoke which is intentionally generated by heating the tobacco or other combustible material. It is difficult at best to regulate the output or by-product of a combustion based heat source in order to prevent excess heat and therefore burning.

Burnt tobacco significantly diminishes the positive aspects of the Hookah experience; the tobacco, or other combustible materials, lose their flavor and produce malodorous foul-tasting clouds of smoke filled with excess particulates, including volatile gasses, ultra-fine particles, and ash. Because of the foregoing, it is necessary to cook tobacco, or other combustibles, within a narrow temperature band to maintain flavor, produce copious amounts of smoke, and avoid the release of the excess particulates identified above.

The Hookah Accessory application by Boutros et al., U.S. patent application Ser. No. 12/888,281, attempts to overcome the problem of properly cooking tobacco by utilizing a top tray configured to hold tobacco, a bottom tray configured to hold hot coal, a hollow rube in fluid communication with the top tray, and an attachment means for attaching the accessory to the Hookah. The bottom tray is attached to a cross bar that allows for it to be moved up and down such that the distance from the coal to the tobacco can be reduced or increased thereby reducing or increasing the amount of heat reaching the tobacco. The problem with the Hookah Accessory is that it does not provide for an easy method of swapping out charcoal without either first waiting for the bottom plate to cool or, alternatively unscrewing the bottom plate while it is still hot. Additionally, while it reduces the amount of large ash particles flowing into the smoke stream inhaled by the user, the proximity and position of the charcoal do nothing to diminish the inhalation of volatile gasses and ultrafine particles. Furthermore, the Hookah accessory appears to be bulky and inconvenient to use.

Therefore at this time, there are no products available to properly cook tobacco, or other combustibles, without introducing significant levels of volatile gasses, ultra-fine particles, and/or ash.

SUMMARY

Described herein is a Hookah Heat Management Accessory comprising: a plate with a flat surface on the top configured to hold hot charcoal, or other heat source, and bulbous protrusions arranged over a flat surface in regular intervals on the bottom with air vents aligned near the outer edge of the plate such that they allow for the free flow of air from the top of the plate to the bottom, which is in direct contact with tobacco or some other combustible material; a wall section connected to the plate, which has columns at regular intervals on the inside wall, and which is also notched on the bottom at regular intervals to allow for ventilation of air and heat; a lower lid that rests upon the wall section, with protrusions at regular intervals on the bottom of the lower lid that are designed to make contact with the columns on the wall, and which has air vents to allow for air to pass through; and an upper lid with air vents for air to pass though that connects directly to the lower lid to allow for fluid rotational movement between the lower and upper lids such that upper lid can be aligned to seal the vents on the lower lid, allow for unobstructed air flow through the vents on the lower lid, or any variation in between.

Also described herein is a Hookah Heat Management Accessory comprising: a plate with a flat surface on the top configured to hold hot charcoal, or other heat source, and bulbous protrusions arranged over a flat surface in regular intervals on the bottom with air vents aligned near the outer edge of the plate such that they allow for the free flow of air from the top of the plate to the bottom, which is in direct contact with tobacco or some other combustible material; a wall section connected to the plate, which has columns at regular intervals on the inside wall, and which is also notched on the bottom at regular intervals to allow for ventilation of air and heat; a lower lid that rests upon the wall section, with protrusions at regular intervals on the bottom of the lower lid that are designed to make contact with the columns on the wall, and which has air vents to allow for air to pass through; and an upper lid with air vents for air to pass though that connects directly to the lower lid to allow for fluid rotational movement between the lower and upper lids such that upper lid can be aligned to seal the vents on the lower lid, allow for unobstructed air flow through the vents on the lower lid, or any variation in between; where the lower lid rests upon the wall section and may be removed at any time by means of a handle protruding from the upper lid.

Further described herein is a Hookah Heat Management Accessory comprising: a plate with a flat surface on the top configured to hold hot charcoal, or other heat source, and bulbous protrusions arranged over a flat surface in regular intervals on the bottom with air vents aligned near the outer edge of the plate such that they allow for the free flow of air from the top of the plate to the bottom, which is in direct contact with tobacco or some other combustible material; a wall section connected to the plate, which has columns at regular intervals on the inside wall, and which is also notched on the bottom at regular intervals to allow for ventilation of air and heat; a lower lid that rests upon the wall section, with protrusions at regular intervals on the bottom of the lower lid that are designed to make contact with the columns on the wall, and which has air vents to allow for air to pass through; and an upper lid with air vents for air to pass though that connects directly to the lower lid to allow for fluid rotational movement between the lower and upper lids such that upper lid can be aligned to seal the vents on the lower lid, allow for unobstructed air flow through the vents on the lower lid, or any variation in between; where the lower lid rests upon the wall section and may be removed at any time by means of a handle protruding from the upper lid; and where the handle protruding from the upper lid may be used to rotate the upper lid in a from left-to-right or from right-to-left above the lower lid thereby increasing or decreasing the amount of heat allowed to flow through the lower lid in the wall section and onto the plate, or, alternatively, increasing or decreasing the amount of heat retained beneath the upper and lower lids.

In this way, it is an aspect of the present invention that the cooking temperature of the tobacco, or other combustible material, may be regulated through manipulation of the relative position of the upper lid with respect to the lower lid. As the upper lid is rotated on the lower lid, the lower lid's movement is restricted through contact between the protrusions on the bottom of the lower lid and the columns on the inside of the wall section.

Another aspect of this invention is that the heat transferred from the plate to the tobacco, or other combustible material is distributed more evenly thereby allowing for more complete cooking of the tobacco or other combustible material without requiring constant user interaction. A further aspect of this invention is that the user can easily swap out old charcoal for new and dispose of excess ash that has built up on the plate by lifting the Hookah Heat Management Accessory off the Hookah head by means of an insulated handle and dumping the ash out.

In the case of a heat source like charcoal, a yet further aspect of this invention is that the proper control of ventilation and that will reduce the amount of charcoal necessary to properly cook the tobacco, or other combustible material, while also extending the life of a piece of charcoal.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

BRIEF DESCRIPTION OF THE DRAWINGS

It should be understood that the subject invention may be embodied in somewhat different forms, that different alignment, protrusions, and shape of cuts may be made and that different materials may be used in the manufacturing of this product. The following is a brief description of the drawings of just a few of the preferred embodiments of the subject Hookah Heat Management Accessory.

DETAILED DESCRIPTION OF PREFERRED EMBODIMENT

Figure 1:
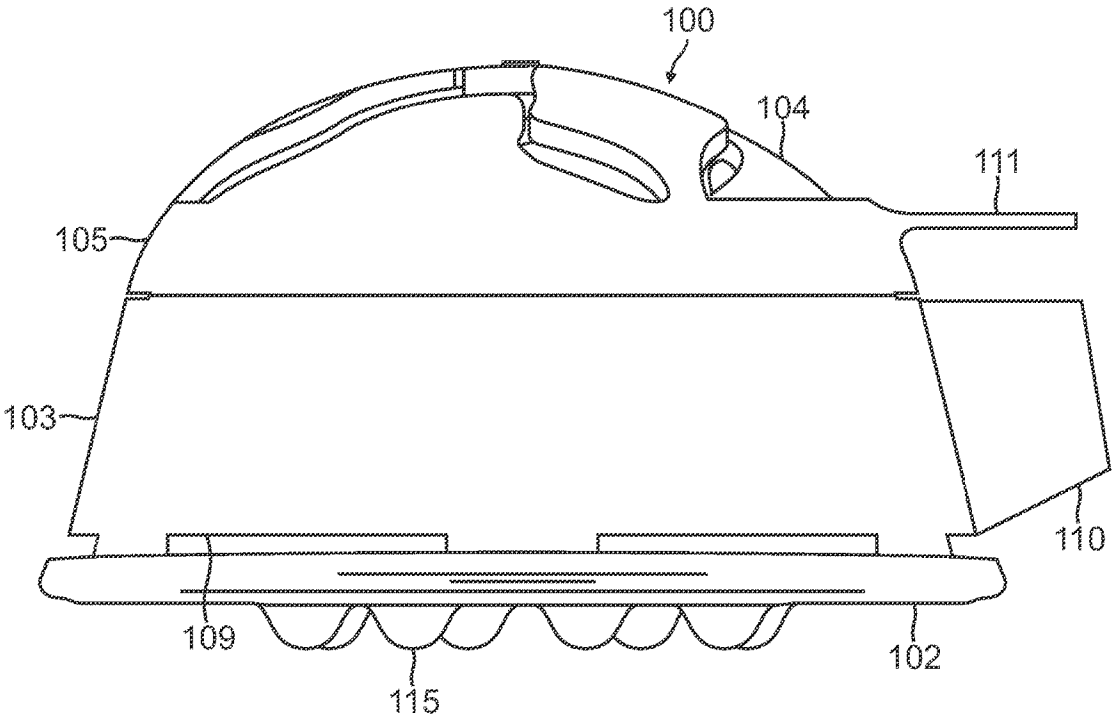
FIG. 1 illustrates one embodiment of the Hookah Heat Management Accessory disclosed herein.
Figure 5:
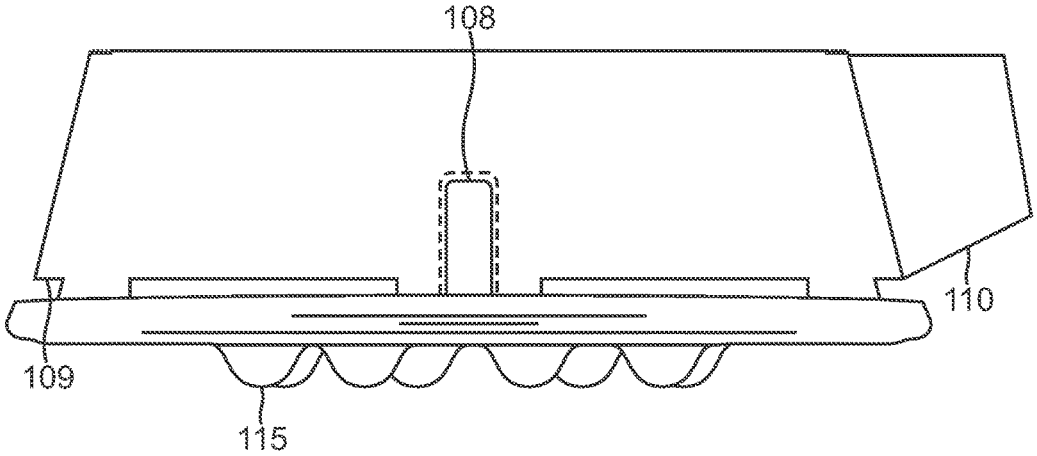
FIG. 5 illustrates the connected plate and wall sections with a cutout designated by dashed lines showing a dowel on the plate mating with a shaft in the wall column.
Figure 6:
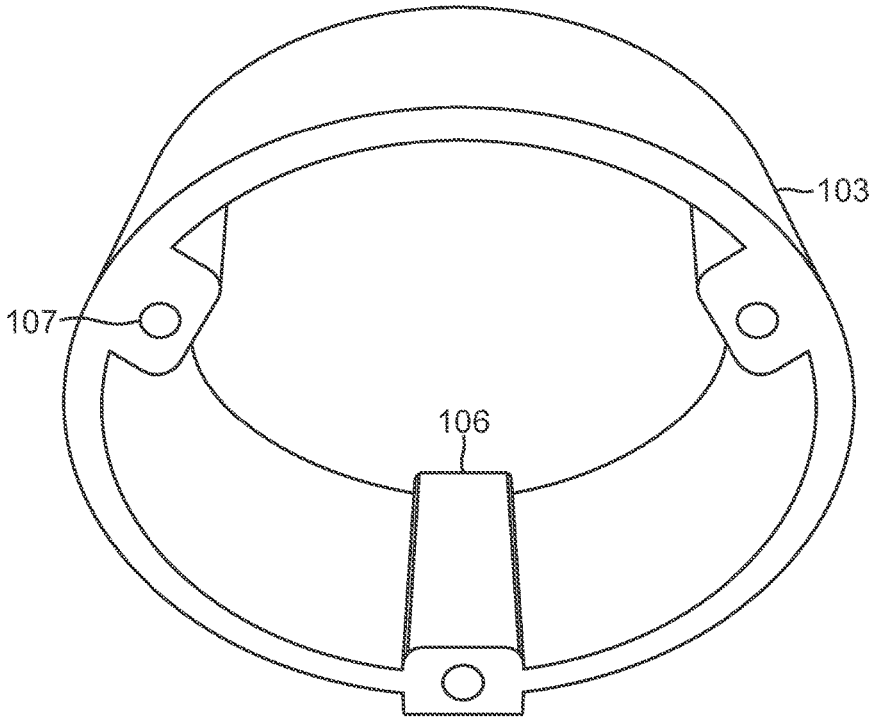
FIG. 6 illustrates one embodiment of the bottom of the columns on the inside of the wall section.
Figure 11:
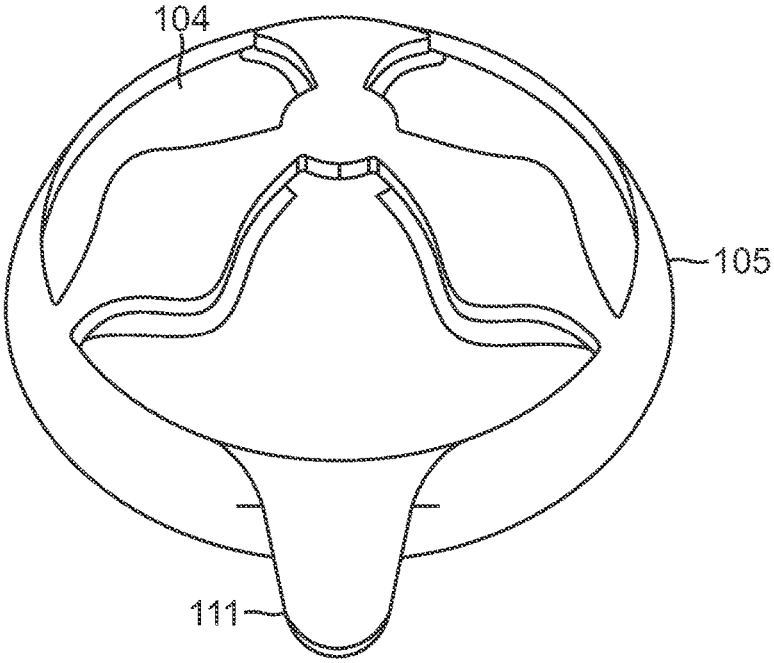
FIG. 11 illustrates one embodiment of the lower lid and upper lid in the closed position.
Figure 12:
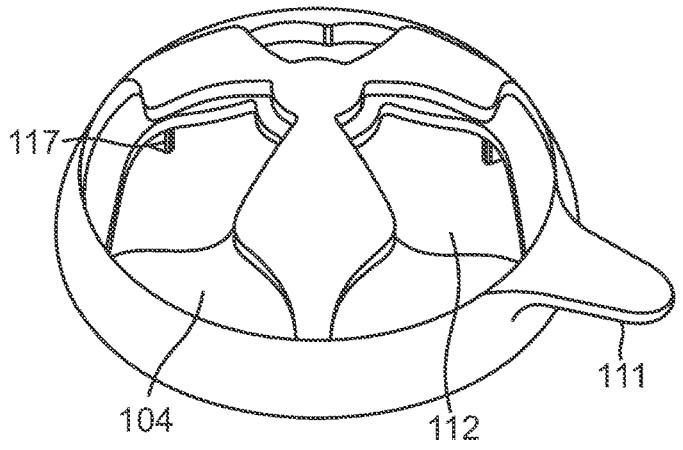
FIG. 12 illustrates one embodiment of the lower lid and the upper lid in the open position.

It should be understood that the subject invention may be embodied in somewhat different forms, that different alignment, protrusions, and shape of cuts may be made and that different materials and processes may be used in the manufacturing of this product. The following is a detailed description of the drawings of the preferred embodiment of the subject Hookah Heat Management Accessory:

Referring first to FIG. 1 and FIG. 5, an embodiment of the Hookah Heat Management Hookah Heat Management Accessory 100 is disclosed herein. The Hookah Heat Management Accessory 100 comprises a plate 102, a wall 103, a lower lid 104, and an upper lid 105, which are all comprised of solid material, preferably metal. The plate 102 is configured for hot charcoal, or other heat source, to be placed on the top and for the bottom to come in direct contact with tobacco, or other combustible material, the wall 103 is configured act in tandem with the plate 102 to hold the charcoal, or other heat source, and the heat it produces within the Hookah Heat Management Accessory 100. As shown in FIG. 6, the wall 103 is further configured with columns 106 spaced at regular intervals in three separate locations that act as a barrier to prevent the lower lid 104 from sliding as the upper lid 105 is rotated using the upper lid 105 handle 111 as shown in FIGS. 11 and 12, and which also have shafts 107 on the bottom to receive the dowels 108 from the plate. The wall 103 is further configured with notches 109 spaced at regular intervals in three separate locations to allow for ventilation of air and heat from the bottom side of the wall 103. As depicted in FIGS. 1 and 5, the wall 103 is still further configured with an integrated handle 110 that protrudes from one side of the wall 103 and runs from top to bottom such that it can be used to pick up the Hookah Heat Management Accessory 100 at high temperature to empty out ash and coal, or to remove it from the head 1302.

Figure 9:
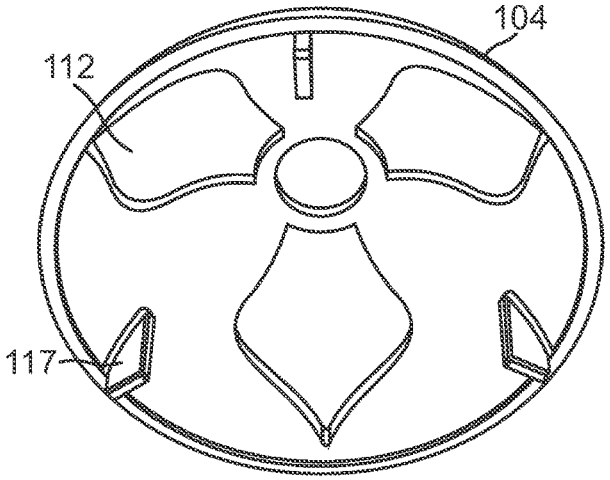
FIG. 9 illustrates one embodiment of the lower lid.
Figure 10:
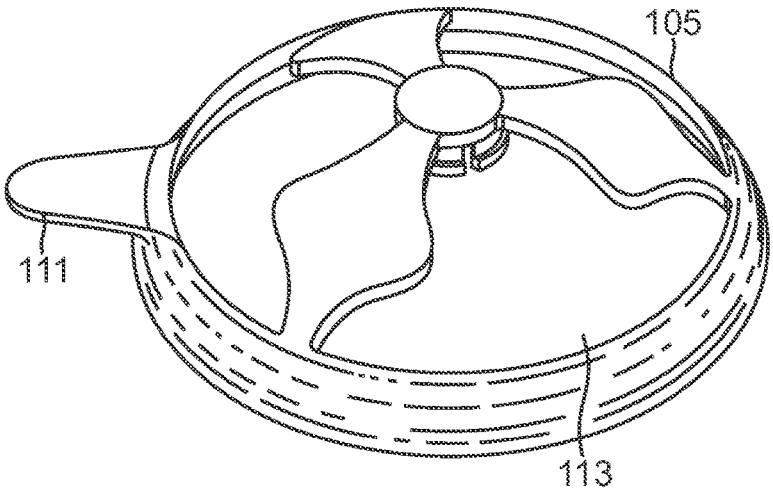
FIG. 10 illustrates one embodiment of the upper lid.

As shown in FIG. 1, the lower lid 104 rests upon the wall 103 and is configured with vents 112 for ventilation of air and heat as represented in FIG. 9. Attached to the lower lid 104 is the upper lid 105, which also has vents 113 for ventilation of air and heat as represented in FIG. 10. Referring now to FIGS. 1 and 10, the upper lid 105 also has a handle 111 horizontally protruding from the base of the upper lid 105 such that a user of the Hookah Heat Management Accessory 100 can manipulate the handle 111 with their fingers, or some other object, to rotate the upper lid 105 to cover the vents 112 of lower lid 104 as in FIG. 11 or to expose the vents 112 of the lower lid 104.

Figure 13:
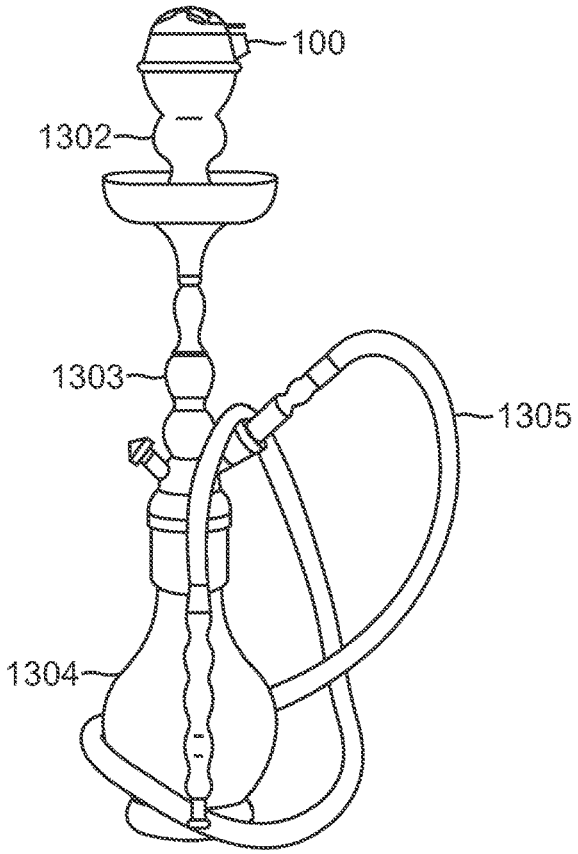
FIG. 13 is a side view of a Hookah with the present invention resting atop the head.

The Hookah Heat Management Accessory 100 rests atop the Hookah 1300 head 1302 as depicted in FIG. 13 with the plate 102 making direct contact with the Hookah 1300 head 1302. The lower lid 104 and the upper lid 105 rest upon the wall 103 and can be removed from the wall 103 by means of the handle 111 protruding from the upper lid 105. This configuration, represented in FIG. 13, allows for the plate 102 to conduct heat directly from the charcoal, or other heat source, to the tobacco, or other combustible material, in the head 1302 at an optimal temperature thereby producing smoke that is then inhaled by the user into the internal pipes 1303 of the Hookah 1300, through the water in the base 1304, into the hose 1305, and finally, the user.

The top of plate 102 is intended to hold hot charcoal, or other heat source. In the embodiment shown in the figures, the shape of the plate 102 is flat with air vents 114 cut near the outer edge of the plate 102 that penetrate through to the bottom of the plate 102. Those of ordinary skill in the art recognize that the top of the plate 102 can be of any shape suitable for holding hot charcoal, or other heat source. For example, the top of the plate 102 can be concave or convex. Alternatively, the top of plate 102 can be made with grooves or ridges carved into it, or with specific compartments for charcoal, or other heat source. The utility of the top of plate 102 is for holding the charcoal, or other heat source; its particular shape and design are aesthetically defined.

Figure 2:
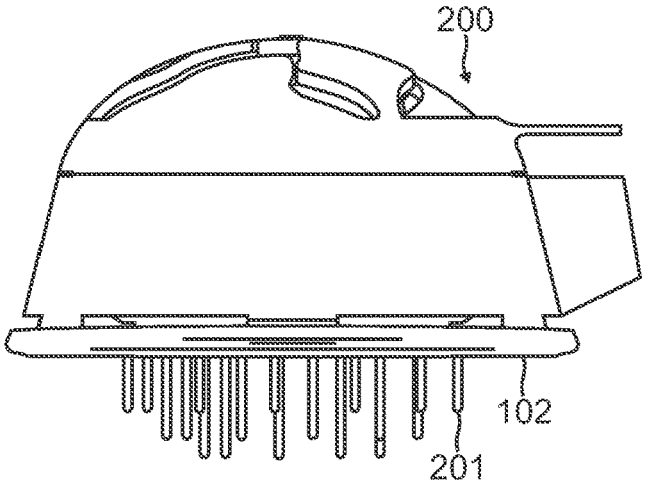
FIG. 2 illustrates one embodiment of the Hookah Heat Management Accessory disclosed herein.
Figure 3:
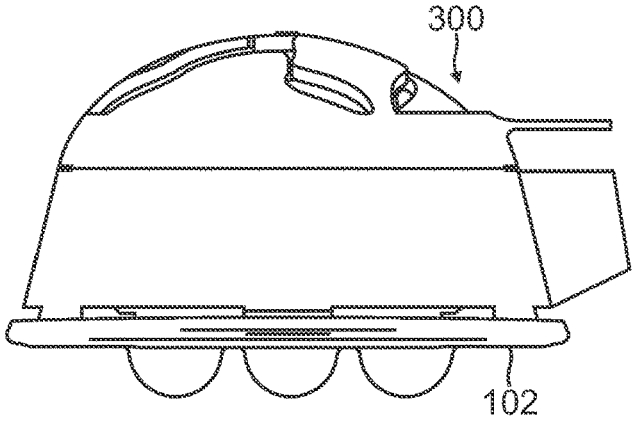
FIG. 3 illustrates one embodiment of the Hookah Heat Management Accessory disclosed herein.

The bottom of plate 102 is intended to make direct contact with and heat the tobacco, or other combustible material, in the head 1302, while the bulbous protrusions 115, represented in FIG. 1, are intended to deliver heat deeper into the tobacco, or other combustible material, at certain locations in the head 1302. In the embodiment shown in the figures, the shape of the plate 102 is flat with air vents 114 cut near the outer edge of the plate 102 that penetrate through to the top of the plate 102. As with the top of the plate 102, those of ordinary skill in the art recognize that the bottom of the plate 102 can be of any shape suitable for conducting heat to the tobacco, or other combustible material, in the head 1302. Again, by way of example, the bottom of the plate 102 can also be concave or convex and have grooves or ridges carved into it. Additionally, the bulbous protrusions 115 located at the bottom of plate 102 can be larger as in FIG. 3 or be made to resemble rods 201 as in FIG. 2, cones, pyramids, ridges, rings, or many other shapes, and, as illustrated in FIG. 3, be of varying sizes and occur with greater or lesser frequency. Alternatively, the bulbous protrusions 115 may be completely removed from the bottom of the plate 102 as in FIG. 4. The utility of the bottom of plate 102 is for conducting heat to the tobacco in the head 1302; its particular shape and design are aesthetically defined.

Figure 7:
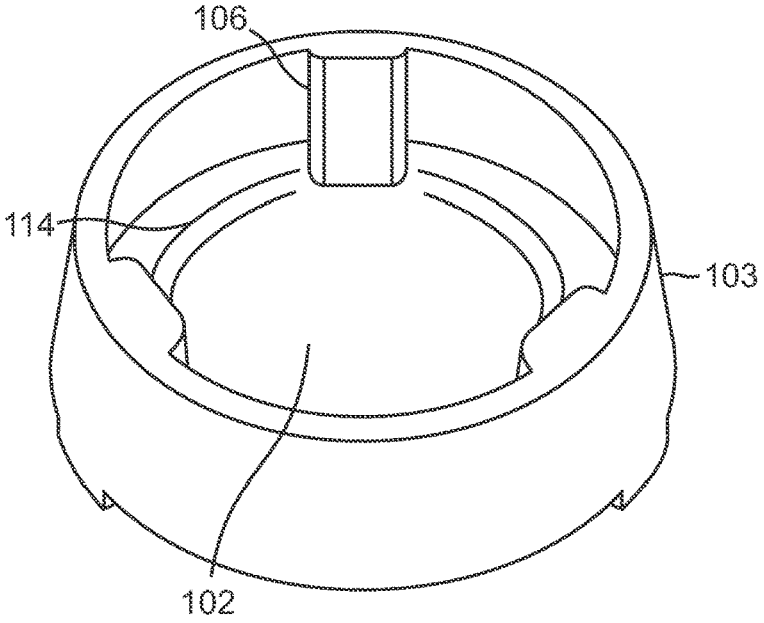
FIG. 7 illustrates one embodiment of the top of the columns on the inside of the wall section and the vents on the plate.
Figure 8:
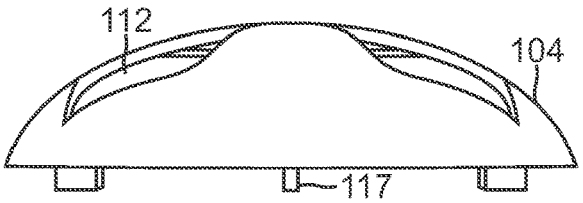
FIG. 8 illustrates one embodiment of the protrusions on bottom of the lower lid and the vents on the lower lid.

The plate 102 is connected to the wall 103 by dowels 108, as represented in FIG. 5, protruding from the plate 102 and which act as male components docking with shafts 107, as represented in FIG. 7. This connection is meant to be secure and prevent the plate 102 from separating from the wall 103 without significant force, beyond ordinary use, being applied. Those of ordinary skill in the art recognize that the plate 102 can connected or attached to the wall 103 in a variety of ways. For example, the plate 102 can connected or attached to the wall 103 by using screws, rivets, spot welds, glue, or as in FIG. 4, the plate 102 and the wall 103 can be manufactured as one piece. The utility of the dowels 108 and the wall 103 shafts 107 is for securing the plate 102 to the wall 103 and is aesthetically defined.

As shown in FIGS. 11 and 12, the upper lid 105 can rotate on the lower lid 104. This allows for the user to quickly and easily rotate the upper lid 105 by way of the handle 111 in order to adjust the amount of heat being conducted to the tobacco, or other combustible material, by releasing heat from the vents 112 of the lower lid 104 and the vents 113 of the upper lid 105.

In some embodiments, the handle 111 comprises a removable piece that locks into the upper lid 105. In other embodiments, the handle 111 comprises a nob at the top of the upper lid 105, a series of dents in the surface of the upper lid 105, or some other mechanism.

In some embodiments, the wall's 103 integrated handle 110 comprises a removable piece that locks into the wall 103. In other embodiments, the wall's 103 integrated handle 110 comprises a nob on the outside of the wall 103, a series of dents in the surface of the wall 103, a neoprene or silicon rubber sleeve, or some other mechanism.

In some embodiments, the upper lid 105 comprises a removable piece with only one vent 113 that can either be rotated above the three vents 112 of the lower lid 104, or be completely lifted off the lower lid 104 by way of the handle 111. In other embodiments, the upper lid 105 comprises a removable piece that has no vents 112 at all and which can be completely lifted off the lower lid 104 by way of the handle 111.

Figure 4:
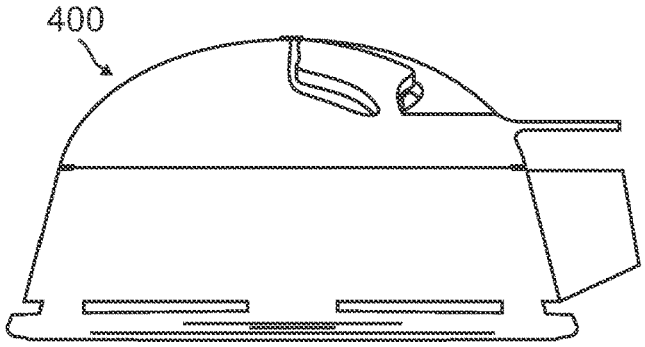
FIG. 4 illustrates one embodiment of the Hookah Heat Management Accessory disclosed herein.

In yet other embodiments, as illustrated in FIG. 4, the plate 102 and wall 103 are comprised of a single piece with more notches 109 cut in at regular intervals around the bottom of the wall 103 for ventilation of heat and air.

The particular shape of the Hookah Heat Management Accessory 100 has no functional utility and is purely aesthetic. The Hookah Heat Management Accessory 100 can take on any other shape, for example it can be triangular, elliptical, square, and the like.

In other embodiments, Hookah Heat Management Accessory 100 is two solid pieces. In these non-illustrated embodiments, the plate 102, the wall 103, and lower lid 104 are all made together with the ability to separate one half of the part from the other. In this way, the Hookah Heat Management Accessory 100 would be split down the middle from top to bottom.

The Hookah Heat Management Accessory 100 rests on the Hookah 1300 on top of the head 1302. In some embodiments, the plate 102 is connected directly to the head 1302 via a lock, clamp, hinge, or some other mechanism. In some embodiments, the plate 102 is a push-fit connection that holds the Hookah Heat Management Accessory 100 in place by friction grip with the head 1302. In other embodiments, the plate 102 screws on head 1302. In yet other embodiments, the plate 102 comprises a screw knob that when tightened, holds the Hookah Heat Management Accessory 100 in place on top of the head 1302. In still other embodiments, the plate 102 comprises a locking tab, dent, or other locking mechanisms.

The use of the Hookah Heat Management Accessory 100 disclosed herein begins by placing the Hookah Heat Management Accessory 100 on the head 1302. The user then places hot charcoal, or other heat source, on the plate 102 such that it is located inside the wall 103. The user then places the connected lower lid 104 and upper lid 105 on the wall 103 in such a way that the protrusions 117 on the bottom of the lower lid 104 abut the columns 106 on the wall 103. As the user smokes from the Hookah 1300, the user can adjust the relative position of the vents 113 on the upper lid 105 to the vents 112 on the lower lid 104 towards the closed or open position and, if necessary, completely remove both lids by means of the handle 111 to achieve the optimal temperature range for cooking the tobacco, or other combustible material.

An additional aspect disclosed herein is the Hookah 1300, to which one of the accessories 100, 200, 300, or 400, as described above is attached. In some embodiments, the aforementioned accessories are permanently affixed to the Hookah 1300, while in other embodiments the aforementioned accessories can be easily removed from the Hookah 1300 and be replaced by another like accessory or by traditional accessories associated with tobacco, or other combustible materials, and charcoal, or other heat source.

The present invention is susceptible to modifications and variations which may be introduced thereto without departing from the inventive concepts. During the course of this disclosure, a particular element is described in terms of one of the illustrated Hookah accessories, i.e., Hookah Heat Management Accessory 100. It is expressly understood that such descriptions equally apply where the same element appears for the other illustrated Hookah accessories, e.g., the accessories 200, 300, and 400, or for any accessory not illustrated but falling within the scope of this disclosure and/or any of its claims.

Furthermore, although the present invention has been described according to what is considered the most practical and preferred embodiment, it is expressly understood that the present invention must not to be limited to the disclosed arrangements, but rather it is intended to cover a multitude arrangements that are included within the spirit and scope of the broadest possible spectrum of interpretation of the appended claims so as to encompass any and all possible modifications and equivalent arrangements.

What is claimed is:

1. A Hookah Heat Management Accessory comprising:
- a plate configured to hold hot charcoal, or other heat source, and conduct heat to tobacco;
- a wall attached to the plate that is configured to contain heat produced by hot charcoal, or other heat source;
- a lower lid with vents for air and heat that rests on the wall; and
- an upper lid with vents for air and heat that rests on the lower lid,
- wherein the lower lid has protrusions emanating downwards from the bottom.

2. The accessory of claim 1, further comprising dowels, wherein the plate is connected to the wall by insertion of the dowels into shafts in columns on the inside of the wall.

3. The accessory of claim 1, wherein the plate has bulbous protrusions on the bottom of the plate.

4. The accessory of claim 1, wherein the plate has vents that follow the curvature of the outer edge of the plate.

5. The accessory of claim 1, wherein an inside surface of the wall has columns.

6. The accessory of claim 5, wherein the inside surface of the wall has columns with shafts to receive dowels from the plate.

7. The accessory of claim 1, further comprising a handle on an outer surface of the wall.

8. The accessory of claim 1, wherein the protrusions of the lower lid come in contact with columns of the wall.

9. The accessory of claim 1, wherein the lower lid has alternating vent and solid sections.

10. The accessory of claim 1, wherein upper lid is attached to the lower lid by means of rivets allowing for fluid rotational movement of the upper lid on the lower lid.

11. The accessory of claim 1, wherein the upper lid has alternating vent and solid sections.

12. The accessory of claim 1, wherein a handle extends from the upper lid.

13. A Hookah Heat Management Accessory comprising:
- a plate configured to hold hot charcoal, or other heat source, and conduct heat to tobacco;
- a wall attached to the plate that is configured to contain heat produced by hot charcoal, or other heat source;
- a lower lid with vents for air and heat that rests on the wall;
- a solid upper lid that rests on the lower lid;
- wherein the plate has vents that follow the curvature of the outer edge of the plate;
- wherein the plate is connected to the wall;
- wherein the wall has a handle on the outside;
- wherein the upper lid has a handle, and wherein the lower lid has protrusions emanating downwards from the bottom.

* * * * *